US009567684B2

(12) United States Patent
Henzirohs et al.

(10) Patent No.: US 9,567,684 B2
(45) Date of Patent: Feb. 14, 2017

(54) METHOD OF OBTAINING A YELLOW GOLD ALLOY DEPOSITION BY GALVANOPLASTY WITHOUT USING TOXIC MATERIALS

(71) Applicant: The Swatch Group Research and Development Ltd, Marin (CH)

(72) Inventors: Christophe Henzirohs, Sonceboz (CH); Guido Plankert, Boppelsen (CH)

(73) Assignee: The Swatch Group Research and Development Ltd, Marin (CH)

( * ) Notice: Subject to any disclaimer, the term of this patent is extended or adjusted under 35 U.S.C. 154(b) by 254 days.

(21) Appl. No.: 14/452,364

(22) Filed: Aug. 5, 2014

(65) Prior Publication Data

US 2015/0027898 A1 Jan. 29, 2015

Related U.S. Application Data

(62) Division of application No. 12/905,788, filed on Oct. 15, 2010.

(30) Foreign Application Priority Data

Oct. 15, 2009 (EP) ..... 09173198

(51) Int. Cl.

| | |
|---|---|
| ***B32B 15/00*** | (2006.01) |
| ***C25D 3/62*** | (2006.01) |
| *B05D 1/18* | (2006.01) |
| *C25D 3/56* | (2006.01) |
| *C25D 7/00* | (2006.01) |
| *C25D 3/58* | (2006.01) |

(52) U.S. Cl.
CPC . *C25D 3/62* (2013.01); *B05D 1/18* (2013.01); *C25D 3/56* (2013.01); *C25D 3/58* (2013.01); *C25D 7/005* (2013.01)

(58) Field of Classification Search
USPC ..... 420/511
See application file for complete search history.

(56) References Cited

U.S. PATENT DOCUMENTS

| | | | | |
|---|---|---|---|---|
| 2,127,676 | A * | 8/1938 | Coleman | C22C 5/02 148/430 |
| 2,141,157 | A * | 12/1938 | Peterson | C22C 5/02 420/483 |
| 2,229,463 | A * | 1/1941 | Leach | C22C 5/02 420/511 |
| 2,596,454 | A | 5/1952 | Williams | |
| 2,660,554 | A | 11/1953 | Ostrow | |
| 2,724,687 | A | 11/1955 | Spreter et al. | |
| 2,976,180 | A | 3/1961 | Brookshire | |
| 3,475,292 | A | 10/1969 | Shoushanian | |
| 3,642,589 | A | 2/1972 | Nobel et al. | |
| 3,666,640 | A | 5/1972 | Smith | |
| 3,749,650 | A | 7/1973 | Dettke et al. | |
| 3,834,879 | A * | 9/1974 | Chin | A44C 21/00 40/27.5 |
| 3,878,066 | A | 4/1975 | Dettke et al. | |
| 4,168,214 | A | 9/1979 | Fletcher et al. | |
| 4,192,723 | A | 3/1980 | Laude et al. | |
| 4,358,351 | A | 11/1982 | Simon et al. | |
| 4,591,415 | A | 5/1986 | Whitlaw | |
| 4,626,324 | A | 12/1986 | Samuels et al. | |
| 4,687,557 | A | 8/1987 | Emmenegger | |
| 4,980,035 | A | 12/1990 | Emmenegger | |
| 5,006,208 | A | 4/1991 | Kuhn et al. | |
| 5,045,411 | A * | 9/1991 | Taylor | C22C 5/02 420/481 |
| 5,085,744 | A | 2/1992 | Brasch | |
| 5,169,514 | A | 12/1992 | Hendriks et al. | |
| 5,244,593 | A | 9/1993 | Roselle et al. | |
| 5,256,275 | A | 10/1993 | Brasch | |
| 5,340,529 | A | 8/1994 | DeWitt et al. | |
| 6,165,342 | A | 12/2000 | Kuhn et al. | |
| 6,576,114 | B1 | 6/2003 | Gioria | |
| 6,814,850 | B1 | 11/2004 | Manz et al. | |
| 2004/0079449 | A1 | 4/2004 | Kanekiyo et al. | |
| 2004/0195107 | A1 | 10/2004 | Chalumeau et al. | |
| 2006/0011471 | A1 | 1/2006 | Grippo | |
| 2006/0254924 | A1 | 11/2006 | Ichihara et al. | |
| 2006/0283714 | A1 | 12/2006 | Egli et al. | |

(Continued)

FOREIGN PATENT DOCUMENTS

| | | |
|---|---|---|
| CH | 390024 | 7/1965 |
| CH | 445434 A | 10/1967 |

(Continued)

OTHER PUBLICATIONS

Cretu et al., "Coloured Gold Alloys", Sep. 1999, Gold Bulletin, vol. 32, pp. 115-126.*

Office Action issued in co-pending related U.S. Appl. No. 12/678,984 on Aug. 28, 2013.

Vianco, P. et al. "Interface reactions between 50In-50Pb solder and electroplated Au layers," Materials Science and Engineering A 409, 179-194, 2005.

Sukanov, V.D. et al. "Features of the Domain Structure of Cu3Au—In(Al) Alloys in Thin Films," UDC 669.21'3: 6203187.3 pp. 1-8, 1994.

Shashkov, O.D. et al., "Precipitant Phase Initiation on Periodic Antiphase Domain Boundaries," Metal Physics and Metal Science, vol. 41, No. 6, pp. 1-12 UDX 539.4: 548.313., 1975.

"Colours of Gold Alloys—Definition, range of colours and designation," International Organization for Standardization, First Edition, 1987.

CAPLUS abstract (Aug. 7, 2007) corresponding to Indian Patent Application No. 1186/CHE/2005, filed in co-pending related application as "Exhibit A."

(Continued)

*Primary Examiner* — Humera Sheikh
*Assistant Examiner* — Seth Dumbris
(74) *Attorney, Agent, or Firm* — Oblon, McClelland, Maier & Neustadt, L.L.P.

(57) ABSTRACT

The invention concerns the field of galvanic depositions and relates to a method of galvanoplastic deposition of a gold alloy on an electrode dipped into a bath including metal gold in alkaline aurocyanide form, organometallic compounds, a wetting agent, a sequestering agent and free cyanide. According to the invention, the alloy metals are copper, in double copper and potassium cyanide form, and silver in cyanide form, allowing a mirror bright yellow gold alloy to be deposited on the electrode.

4 Claims, No Drawings

(56) References Cited

U.S. PATENT DOCUMENTS

| | | | | |
|---|---|---|---|---|
| 2010/0206739 | A1 | 8/2010 | Aliprandini et al. | |
| 2015/0071814 | A1* | 3/2015 | Feinberg | C22C 5/02 420/508 |

FOREIGN PATENT DOCUMENTS

| | | | | |
|---|---|---|---|---|
| CH | 555412 | | 11/1971 | |
| CH | 680927 | A5 | 12/1992 | |
| CH | 682823 | A5 | 11/1993 | |
| DE | 1 696 087 | | 1/1972 | |
| DE | 2829979 | C3 | 6/1990 | |
| EP | 0 193 848 | A1 | 9/1986 | |
| EP | 0 384 679 | A1 | 8/1990 | |
| EP | 0 416 342 | A1 | 3/1991 | |
| EP | 0 480 876 | A2 | 4/1992 | |
| EP | 0 566 054 | A1 | 4/1993 | |
| EP | 1 728 898 | A2 | 12/2006 | |
| FR | 2405312 | | 10/1977 | |
| GB | 1 134 615 | | 11/1968 | |
| GB | 1 156 186 | | 6/1969 | |
| GB | 1 294 601 | | 11/1972 | |
| GB | 1 400 492 | | 7/1975 | |
| IN | 2005CH01186 | A | 7/2007 | |
| JP | 62-164890 | | 7/1987 | |
| JP | 01-247570 | | 10/1989 | |
| JP | H06007210 | * | 1/1994 | A44C 9/00 |
| JP | 09310166 | * | 2/1997 | C23C 14/02 |
| JP | 2005-214903 | A | 8/2005 | |
| WO | 97/17482 | A1 | 5/1997 | |
| WO | 2009/037180 | A1 | 3/2009 | |

OTHER PUBLICATIONS

Document obtained from Molecular Connections Pvt., Ltd. (2012), which Applicants reasonably believe is a text from Indian Patent Application No. 1186/CHE/2005, filed in co-pending related application as "Exhibit B."

"Gold and Gold Alloys," at http://www.keytometals.com/Print.aspx?id=CheckArticle&site=ktn&LN=EN&NM=230 (Nov. 2009).

Espacenet—Biblographic data corresponding to EP 0 480 876 A2, last updated Mar. 13, 2013, filed as "Exhibit A" in a co-pending related application.

"Casting and Solidification Process" (Jan. 9, 2010), available at http://www.scribd.com/doc/82888156/5-Solidification-Lab.pdf (last visited Jul. 2, 2013).

"Gold Education, Gold Karat Chart, Care of Gold Jewelry," at http://www.netcarats.com/eductation/gold-education.html (downloaded Jul. 4, 2013).

"Finishing Techniques in Metalwork," at http://www.philamuseum.org/booklets/&_42_74_1.html (2013)(downloaded Jul. 6, 2013).

"Carats v. Karats," at http://dendritics.com/scales/carat-def.asp (2013)(downloaded Jul. 5, 2013).

Peter Krauth, "Seven Ways to Tell if Your Gold is Counterfeit," at http://moneymorning.com/2013/01/02/seven-ways-to-tell-if-your-gold-is-counterfeit/ (Jan. 2, 2013).

Machine translation of EP 0480876, downloaded Jun. 13, 2011.

Weisberg, Alfred, Gold Plating; Metal Finishing, Elsevier Science and Technology, Jan. 2000, vol. 98, Issue 1.

European Search Report issued in corresponding application No. EP09173198, completed Mar. 29, 2010.

Database WPI Thomson Scientific, London, GB; AN 1987-240265 XP002574602 & JP 62 164890 A (Seiko Instr & Electronics Jul. 21, 1987 (Jul. 21, 1987).

Electroforming, Wikipedia.com, available at http://en.wikipedia.org/wiki/Electroforming (downloaded Nov. 7, 2013, 5:59 PM).

Patent Search Results for Claims Containing the Terms "Has" or "Includes", USPTO.gov, available at http://patft.uspto.gov/netacgi/nph-Parser?Sect1=PTO2&Sect2=HITOFF&p=1&u=%2Fnetahtml%2FPTO%2Fsearch-bool.html&r=0&f=S&I=50&TERM1=has&FIELD1=&co1=OR&TERM2=includes&FIELD2=&d=PTXT (downloaded Nov. 7, 2013, 6:08 PM).

Patent Search Results for Claims Containing the Terms "Has" and "Includes", USPTO.gov, available at http://patft.uspto.gov/netacgi/nph-Parser?Sect1=PTO2&Sect2=HITOFF&p=1&u=%2Fnetahtml%2FPTO%2Fsearch-bool.html&r=0&f=S&I=50&TERM1=includes&FIELD1=ACLM&co1=AND&TERM2=has&FIELD2=&d=PTXT (downloaded Nov. 7, 2013, 6:10 PM).

Anselm T. Kuhn & Leslie V. Lewis, The Electroforming of Gold and Its Alloys, 21 Gold Bulletin 17, 17 (1988, issue 1), available at http://link.springer.com/article/10.1007/BF03214663.

Colours of Gold Alloys—Definition, Range of Colours and Designation, ISO 8654 (1st ed., Aug. 15, 1987).

Machine translation of WO 2009/037180, Dec. 31, 2012, pp. 1-4.

Green et al., "A Novel Process for Low-Carat Gold Electroplating Without Cadmium", Oberflaeche-Surface (no month, 1990), vol. 31, No. 10, pp. 11-13.

Office Action issued in co-pending related U.S. Appl. No. 12/678,984 on May 28, 2014.

Office Action in co-pending related U.S. Appl. No. 14/244,071 on Jul. 16, 2015.

Office Action issued in co-pending related U.S. Appl. No. 14/244,071 on Oct. 28, 2015.

Office Action issued in co-pending related U.S. Appl. No. 12/678,984 on Apr. 29, 2015.

* cited by examiner

METHOD OF OBTAINING A YELLOW GOLD ALLOY DEPOSITION BY GALVANOPLASTY WITHOUT USING TOXIC MATERIALS

This application is a division of U.S patent application Ser. No. 12/905,788, filed Oct. 15, 2010, which claims priority from European Patent Application No. 09173198.4 filed Oct. 15, 2009, the entire disclosures of which are incorporated herein by reference.

FIELD OF THE INVENTION

The invention relates to electrolytic deposition in the form of a thick gold alloy layer and the method of fabricating the same.

BACKGROUND OF THE INVENTION

In the field of decorative plating, methods are known for producing yellow coloured, electrolytic depositions of gold, with a grade equal to or more than 9 carats, which is ductile, with a thickness of 10 microns and with a high level of tarnish resistance. These depositions are obtained by electrolysis in an alkaline galvanic bath containing 0.1 to 3 $g \cdot l^{-1}$ cadmium, in addition to gold and copper.

The depositions obtained by these known methods have, however, a cadmium content of between 1 and 10%. Cadmium facilitates deposition of thick layers, i.e. between 1 and 800 microns and provides a yellow coloured alloy while reducing the quantity of copper contained in the alloy. However, cadmium is extremely toxic and prohibited in some countries.

18 carat gold alloys without any cadmium, which contain copper and zinc, are also known. However, these depositions have an excessively pink hue (too rich in copper). Finally, these depositions have poor corrosion resistance which means they tarnish quickly.

SUMMARY OF THE INVENTION

It is an object of the present invention to overcome all or part of the aforementioned drawbacks, by providing a manufacturing method for depositing a thick, yellow coloured, gold alloy layer which has neither zinc nor cadmium as its main constituents.

The invention therefore relates to a method for the galvanoplastic deposition of a gold alloy on an electrode dipped in a bath that includes metal gold in the form of alkaline aurocyanide, organometallic compounds, a wetting agent, a sequestering agent and free cyanide, characterized in that the alloy metals are copper, in the form of double copper and potassium cyanide, and silver, in cyanide form, allowing a mirror-bright yellow gold alloy to be deposited on the electrode.

According to other advantageous features of the invention:

- the bath includes 1 to 10 $g \cdot l^{-1}$ gold metal in the form of alkaline aurocyanide;
- the bath includes 30 to 80 $g \cdot l^{-1}$ copper metal in the form of alkaline double cyanide;
- the bath includes 10 $mg \cdot l^{-1}$ to 1 $g \cdot l^{-1}$ silver metal in complex form;
- the bath includes 15 to 35 $g \cdot l^{-1}$ cyanide;
- the wetting agent has a concentration of between 0.05 and 10 $ml \cdot ^{-1}$

- the wetting agent is chosen from among polyoxyalkenic, ether phosphate, lauryl sulphate, dimethyldodecylamine-N-oxide, dimethyl(dodecyl) ammonium propane sulfonate;
- the bath includes a concentration of amine of between 0.01 and 5 $ml \cdot l^{-1}$;
- the bath includes a concentration of depolariser of between 0.1 $mg \cdot l^{-1}$ and 20 $mg \cdot l^{-1}$;
- the bath includes phosphate, carbonate, citrate, sulphate, tartrate, gluconate and/or phosphonate type conductive salts;
- the temperature of the bath is kept between 50 and 80° C.;
- the pH of the bath is kept between 8 and 12;
- the method is performed with a current density of between 0.05 and 1.5 $A \cdot dm^{-2}$;
- the bath respects a proportion of 9.08% gold, 90.85% copper and 0.07% silver.

The invention also concerns an electrolytic deposition in the form of a gold alloy obtained from a method according to any of the preceding claims, whose thickness is comprised between 1 and 800 microns and which includes copper, characterized in that it includes silver as the third main compound in a proportion of 75% gold, 21% copper and 4% silver to obtain a bright 3N colour.

DETAILED DESCRIPTION OF THE PREFERRED EMBODIMENTS

The invention concerns an electrolytic deposition of a gold alloy with a 3N colour which, surprisingly, includes Au—Cu—Ag as its main compounds in proportions that are not known, to obtain the 3N colour, i.e. bright yellow.

In the example deposition above, there is a gold alloy, free of toxic metals or metalloids, and in particular free of cadmium, with a 3N yellow colour, a thickness of 200 microns, excellent brightness and with a very high level of resistance to wear and tarnishing.

This deposition is obtained by electrolysis in an electrolytic bath of the type:

- Au: 5.5 $g \cdot l^{-1}$;
- Cu: 55 $g \cdot ^{-1}$;
- Ag: 40 $mg \cdot l^{-1}$;
- KCN: 26 $g \cdot l^{-1}$;
- pH: 10.5;
- Temperature: 65° C.;
- Current density: 0.3 $A \cdot dm^{-2}$;
- Wetting agent: 0.05 $ml \cdot l^{-1}$ NN_Dimethyldodecyl N-oxide;
- Iminodiacetic: 20 $g \cdot l^{-1}$;
- Ethylenediamene: 0.5 $ml \cdot l^{-1}$;
- Gallium, selenium or tellurium: 10 $mg \cdot l^{-1}$.

The electrolysis is preferably followed by a heat treatment at a temperature of between 200 and 450 degrees Celsius for 1 to 30 minutes in order to obtain a deposition of optimum quality.

These conditions provide a cathodic yield of 98 $mg \cdot A \cdot min^{-1}$ with a deposition speed of around 10 ||m per hour in the case of the example.

Thus, surprisingly, the bath according to the invention provides a deposition in proportions of around 75% gold, 21% copper and 4% silver, corresponding to a 3N colour, 18 carat deposition, very different proportions from the usual electrolytic depositions for this colour, which tend to be depositions of around 75% gold, 12.5% copper and 12.5% silver.

The bath may also contain a brightener. This is preferably a butynediol derivative, a pyridinio-propanesulfonate or a mixture of the two, a tin salt, sulfonated castor oil, methylimidozole, dithiocarboxylic acid such as thiocarbamide, thiobarbituric acid, imidazolidinthion or thiomalic acid.

In these examples, the electrolytic bath is contained in a polypropylene or PVC bath holder with a heat insulating coating. The bath is heated using quartz, PTFE, porcelain or stabilised stainless steel thermo-plungers. Good cathodic rod movement and electrolyte flow must be maintained. The anodes are made of platinum plated titanium, stainless steel, ruthenium, iridium or alloys of the latter two.

Of course, the present invention is not limited to the illustrated example but is capable of various variants and alterations which will be clear to those skilled in the art. In particular, the bath may contain the following metals: Zr, Se, Te, Sb, Sn, Ga, As, Sr, Be, Bi in negligible quantities.

Moreover, the wetting agent may be of any type that can wet in an alkaline cyanide medium.

What is claimed is:

1. An electrolytic deposition comprising:

a galvanoplastically deposited gold alloy layer, said alloy being a bright 3N colour gold alloy composition of 75% gold, 21% copper, and 4% silver, and being free of cadmium and zinc, said layer being between about 1 μm and about 800 μm thick, wherein a structure of said alloy composition is formed by dipping an electrode into a bath comprising a proportion of 9.08% gold metal in alkaline aurocyanide form, 90.85% copper metal in alkaline double cyanide form, 0.07% silver metal, organometallic compounds, a wetting agent, a sequestering agent, and free cyanide.

2. The electrolytic deposition, according to claim 1, wherein the structure of said alloy composition is formed when the bath is held at a temperature between about 50° C. and about 80° C., at a pH between about 8 and about 12, and to which a current density of between about 0.05 $A/dm^2$ and about 1.5 $A/dm^2$ is applied.

3. A gold alloy layer galvanoplastically deposited on an electrode, the galvanoplastically deposited gold alloy layer comprising:

a bright 3N colour gold alloy composition of 75% gold, 21% copper, and 4% silver, and being free of cadmium and zinc, said layer being between about 1 μm and about 800 μm thick, wherein a structure of said alloy composition is formed from an electrolytic bath comprising a proportion of 9.08% gold metal in alkaline aurocyanide form, 90.85% copper metal in alkaline double cyanide form, and 0.07% silver metal.

4. An electrode, comprising:

a galvanoplastically deposited gold alloy layer, said alloy being a bright 3N colour gold alloy composition of 75% gold, 21% copper, and 4% silver, and being free of cadmium and zinc, said layer being between about 1 μm and about 800 μm thick, wherein a structure of said alloy composition is formed from an electrolytic bath comprising a proportion of 9.08% gold metal in alkaline aurocyanide form, 90.85% copper metal in alkaline double cyanide form, and 0.07% silver metal.

* * * * *